US006596328B1

(12) United States Patent
Bezek et al.

(10) Patent No.: US 6,596,328 B1
(45) **Date of Patent: *Jul. 22, 2003**

(54) CONSUMABLES CONTAINER WITH MULTI-FUNCTIONAL CAP

(75) Inventors: Edward Anthony Bezek, Frisco, TX (US); Patrick Joseph Bierschenk, Dallas, TX (US); John Joseph Michels, Highland Village, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/538,540

(22) Filed: Mar. 30, 2000

(51) Int. Cl.[7] ..... B65D 51/20

(52) U.S. Cl. ..... 426/115; 426/106; 426/131; 206/497; 206/505; 215/384; 215/387; 220/212

(58) Field of Search ..... 215/7 D, 382, 215/383, 384, 387, 232, 228; 206/215, 217, 497, 505, 515, 543; 220/212; 228/392, 393; 426/106, 115, 131

(56) References Cited

U.S. PATENT DOCUMENTS

| | | | | |
|---|---|---|---|---|
| 2,076,132 | A | 4/1937 | Le Rose | |
| 2,121,041 | A | 6/1938 | Morgan | |
| 2,297,285 | A | 9/1942 | Bledsoe | |
| 2,346,417 | A | 4/1944 | Cornwell | |
| 2,533,349 | A | 12/1950 | Burger | |
| 2,543,427 | A | 2/1951 | Warne | |
| 2,619,245 | A | 11/1952 | Levi | |
| 2,766,796 | A | * 10/1956 | Tupper | 426/106 |
| 3,021,977 | A | 2/1962 | Hester | |
| 3,760,968 | A | 9/1973 | Amberg et al. | |
| 3,915,296 | A | * 10/1975 | Spencer | 206/217 |
| 4,051,265 | A | * 9/1977 | Kirshenbaum et al. | 426/107 |
| 4,054,220 | A | 10/1977 | Rosenstein | |
| D246,896 | S | 1/1978 | Plummer | |
| D247,471 | S | 3/1978 | Strand | |
| D247,472 | S | 3/1978 | Byrne | |
| D247,847 | S | 5/1978 | Kretz | |
| 4,190,168 | A | 2/1980 | Jacques | |
| D254,840 | S | 4/1980 | Aldrich, III | |
| RE30,805 | E | 11/1981 | Rhoads | |
| 4,417,504 | A | * 11/1983 | Yamamoto | 426/115 |
| 4,444,324 | A | * 4/1984 | Grenell | 426/115 |
| 4,483,890 | A | 11/1984 | Beery et al. | |
| D345,695 | S | 4/1994 | Frazer et al. | |
| 5,383,558 | A | * 1/1995 | Wilkinson et al. | 206/508 |
| D371,304 | S | 7/1996 | Onneweer | |
| 5,788,076 | A | * 8/1998 | Simmons | 206/459.5 |
| 5,797,509 | A | * 8/1998 | Fitch | 220/258 |
| 6,006,945 | A | 12/1999 | Kirkland | |
| D418,758 | S | 1/2000 | Yucknut | |

FOREIGN PATENT DOCUMENTS

| | | |
|---|---|---|
| FR | 2646071 | 4/1989 |
| WO | WO 92/04243 | 3/1992 |

OTHER PUBLICATIONS

Advertisement by Land O' Lakes showing a personal size container for beverages, trademarked as the "Grip". It also has a resealable top.

* cited by examiner

*Primary Examiner*—N Bhat
(74) *Attorney, Agent, or Firm*—Colin P. Cahoon; Carstens, Yee & Cahoon, L.L.P.

(57) ABSTRACT

An improved container for food and other perishable products comprising a simple construction and a multi-functional cap. The receptacle portion is a blow molded plastic, while a outer layer comprising a shrink-wrap graphics carrier is applied over the receptacle and cap. The multi-functional cap nests over and seals the mouth end of the container, inverts to seat on the mouth of the container as a bowl, and nests over the base of the container for storage while the container is in use.

31 Claims, 5 Drawing Sheets

CONSUMABLES CONTAINER WITH MULTI-FUNCTIONAL CAP

BACKGROUND OF THE INVENTION

1. Technical Field

The present invention relates to a rigid container or canister suitable for storing food products (consumables) with a multi-functional cap. In one embodiment, the cap nests over the mouth end of the container when the container is sealed, but can also nest with the base end of the container for storage while the container is in use. Further, when inverted, the cap seats into the open end, thereby acting as a bowl. The container consists of a molded body that can be wrapped with a thin film graphics carrier. In one embodiment of the invention, the thin film graphics carrier contributes to the barrier properties of the container. The container stands unsupported for a shelf display or can be vendable from soft drink vending machines.

2. Description of Related Art

The design and construction of packaging for containers of consumables, such as potato chips, tortilla chips, or other snack products, requires the consideration of several sometimes competing factors. One factor to consider is that the container must be designed to protect the product contained therein from degradation, microbial spoilage, and physical damage. Ideally, the container should possess barrier properties that limit or prohibit the migration of oxygen and moisture through the container when sealed and product exposure to light. Oxygen and moisture migration into a container reduces the product's shelf life. Product degradation can also be slowed if the barrier properties of the container limit the exposure of the product to light. Breakage of the product can be limited by either placing the product in a rigid container or providing sufficient slack-fill in a non-rigid container to provide an air cushion within the container.

Another factor to consider regarding consumables container design is the marketing aspect, or presentation, of the container. A consumables container should provide an appealing presentation of the product contained therein. It is often desirable that the container be capable of standing unsupported on a store shelf. Further, the container must be capable of supporting graphics either affixed to the container or embedded in the container to assist with brand recognition and the appearance of the packaging. Many prior art containers are constructed of at least three layers, and typically more, consisting of a moisture barrier, an oxygen barrier, a light barrier, and a graphics carrier, all of which are molded or shaped for a desired presentation.

The specific barrier properties of a container are frequently dependent on the product that must be protected. For example, some products, such as crackers, do not need an oxygen barrier for protection. Likewise, other products may not need a moisture barrier or a visible light barrier. Consequently, containers are usually designed with the minimal barrier properties required to protect the specific products to be contained therein.

Another factor in consumables container design is the economics and efficiencies of filling and shipping the container. Containers are ideally constructed to easily and efficiently fill with product on a production line. Further, the containers must fit economically into boxes or crates in order to minimize shipping costs. It might also be beneficial for individual components of a container, such as a container cap, to be easily stacked for shipment and handling prior to installation on the container.

Another design criteria for consumables container design is the cost and ease of construction of the container. Every layer added to the container may provide additional desired barrier properties. However, the addition of every layer also drives up the cost of constructing the container. Generally speaking, less expensive containers limit the layers of material and the amount of material involved in the construction of the container.

A design of a specific consumables container may also have many application specific design criteria. For example, and related to marketing considerations, it may be desirable to construct the container so that it is particularly useful in dispensing or holding a product while being used by the consumer. The container may be designed with an easy-open top, a dimension or shape that makes it easy to hold the container in one hand, and an opening sufficient in size for the consumer to retrieve the product from the container by pulling out the product by hand. Another example of an application specific consideration involves dispensing consumables containers from what are traditionally soft drink vending machines. Such containers, referred to as "vendable" containers, must be designed of an appropriate dimension and weight to be easily loaded and dispensed from standard soft drink vending machines. Such dimensions can also make a container suitable for use with a cup holder in an automobile.

Likewise, the ergonomics of the container must be considered. The container can be designed to be easily grasped and held in one hand. Some containers are designed to allow for direct consumption of the product by pouring the product out of the container into the consumer's mouth.

The utility of various components of the container is also an important design consideration. The cap that seals the container might also be used as a bowl or cup to hold the product for consumption by the consumer. The container itself may provide for other functional uses or provide for special re-seal capabilities.

The above items are not all-inclusive, but representative of design considerations regarding consumables containers. Frequently, these and other design considerations are in conflict and require balance and compromise. For example, a certain marketing look or presentation may be impractical because it reduces packaging efficiencies or gives rise to difficulties in production line filling or construction. Heavy and multi-layered construction provides ideal barrier properties for protecting a product, but can greatly increase the cost and complexity of construction. The addition of consumer oriented features, such as easy open and resealable tops, can also introduce complexities in manufacturing and increases overall cost. As a result, the snack food industry has yet to develop a container that is of simple and inexpensive construction, provides a unique shelf presentation, provides various consumer friendly features that allow for single-handed operation, and provides for sufficient barrier properties in an economical and efficient design.

In particular, there does not exist in the prior art a vendable consumables container with a cap that performs several functions in an efficient, simple, and economical design. Most containers with removable caps do not provide for any function for the removable cap other than for use to reseal the container. Further, there is typically no provision on the container for stowage of the removable cap while the container is in use. Frequently, a second cup or bowl must be used, independent from the container, when the consumer wants to pour out only a portion of the food product in the container. While some prior art containers combine two of the features listed above, none of them incorporate a cap design that acts as a cup that can be placed on top of the container, can be stored on the bottom of the container when not in use, and used to seal the container for storage of the food product, along with a container design that lends itself to single-handed use by the consumer in a vendable and shelf presentable package.

Accordingly, a need exists for an easily manufactured consumables container that incorporates a multi-functional cap with an economical design. The container should provide acceptable and appropriate barrier properties, as well as physical containment and protection of the product. The multi-functional cap should act as a sealing means on the mouth end of the container, should store on the bottom of the container when not in use, and should act as a cup or bowl that can be seated on the top of the container for single-hand use by the consumer. The container should be capable of standing unassisted on store shelves or, alternatively, being dispensed from a soft drink vending machine. Such a design should be simple and inexpensive to manufacture, provide for packaging and filling efficiencies, and be intuitively functional to the consumer.

SUMMARY OF THE INVENTION

The proposed invention comprises an economically designed, vendable container for snacks and other perishable foods with a multi-functional cap. One embodiment comprises a generally cylindrical container with a multi-functional cap nested over the mouth end of the container and an outer film wrapped over the cap and container after the container is filled. The outer film can also complement the barrier properties of the container.

The invention is simple and inexpensive to manufacture, provides adequate protection for the product contained therein, and is easy to use for the consumer. The multi-functional cap reseals the container, can be used as a bowl for product when seated on the top of the container, or can be stored by nesting over the bottom of the container. The container is capable of standing unassisted on a store shelf or being dispensed from a soft drink vending machine. The container is an improvement over the prior art in ease of manufacture, packaging efficiencies, and functional use by the consumer.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
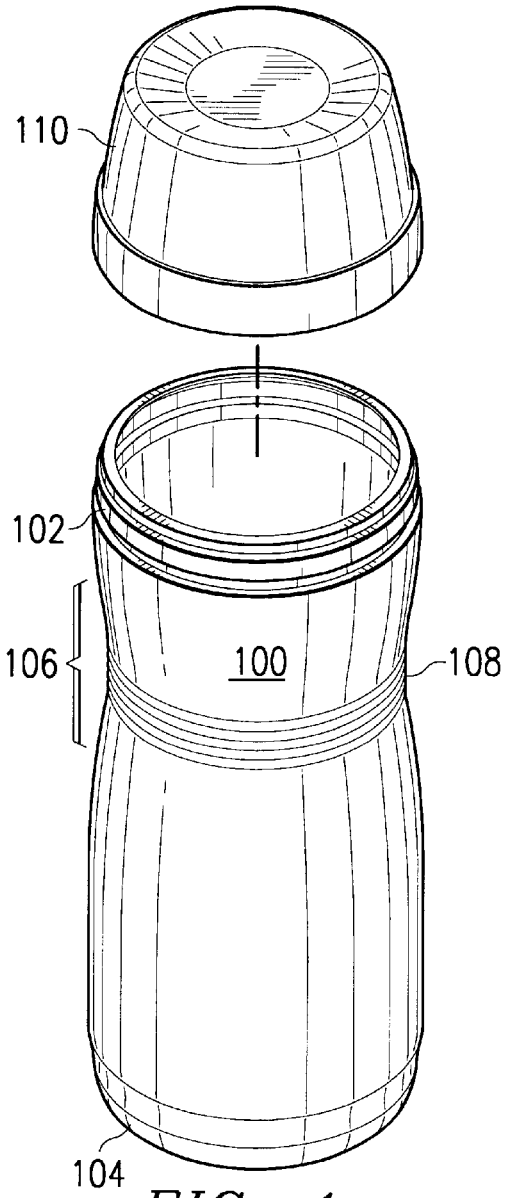
FIGS. 1*a* and 1*b* are perspective views showing a cylindrical embodiment of the invention.
Figure 1B:
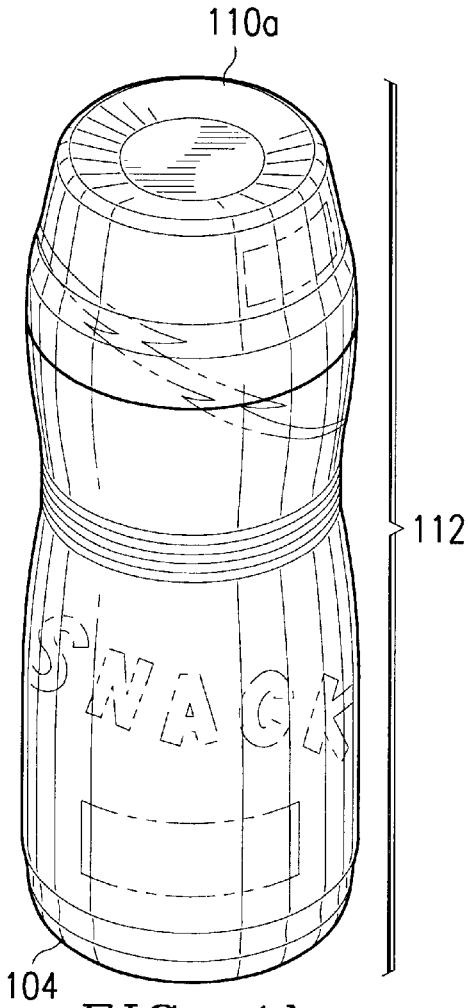

FIGS. 1*a* and 1*b* show perspective views of a cylindrical embodiment of the present invention. Referring to FIG. 1*a*, the container comprises a receptacle 100 which provides for the rigidity of the container as well as necessary oxygen and moisture barrier properties. The receptacle 100 can also be opaque in order to preclude exposure to light on the product contained therein. The receptacle 100 is typically blow molded and can be constructed of high density polyethylene, which provides for effective moisture barrier properties, or ethethylene vinyl alcohol, which provides for effective oxygen barrier properties. Examples of other suitable material for use in constructing the receptacle include polyethylene and polyester. In an alternative embodiment, the receptacle 100 can be multi-layers or constructed of a material that provides for both effective oxygen and moisture barrier properties.

The receptacle 100 comprises a mouth end 102, a base end 104, and a slightly circumferentially constricted central section 106. The constricted central section 106, in one embodiment, comprises corrugation 108 about the circumference of the container. This corrugation 108 provides additional circumferential strength and, in combination with the tapering to slight constriction of the central section 106, a convenient hand grip for the consumer.

The mouth end 102 of the receptacle 100 is tapered to nest with a cap 110. The mouth end 102 is also dimensioned such as to allow the cap 110 to be inverted and act as a cup when placed or seated into the mouth end 102, as will be described in further detail in conjunction with FIG. 3. The cap 110 is also dimensioned to nest over the container base 104, as will be further described in connection with FIG. 4.

The first step in manufacturing the container of Applicants' invention involves constructing the receptacle 100. This is typically done by blow-molding of the material selected, but could also be accomplished by injection molding, thermal forming, or other means used in container manufacturing. After the receptacle 100 is removed from the mold, it can be filled with product or consumables, such as corn-based snack foods, dropped into the receptacle 100 through the mouth end 102. After the receptacle 100 is filled with product, a removable seal (shown as reference 220 in FIG. 2*a*) is secured over the end 102 of the container by methods well known in the industry. This removable seal can be, for example, a metalized polyester secured by a heat and pressure seal or other means. Once the removable seal is placed over the mouth end 102, the cap 110 is then nested over the mouth 102.

Referring to FIG. 1*b*, an outer layer 102 then wrapped over the cap 110 and a portion of the receptacle 100. In the alternative embodiment that requires more barrier properties than provided by the receptacle 100, the selection of whether the outer layer 112 is a material that also provides additional oxygen barrier, moisture barrier, or light barrier properties depends on the selection of the material used for the receptacle 100 if the receptacle 100 material provides an oxygen barrier, the outer layer 112 material selected could provide moisture barrier properties, and vice versa. The outer layer 112 can also act as a graphics carrier. Alternatively, the container can be constructed without an outer layer 112 by embedding graphics within the receptacle 100 or screen printing graphics directly on the receptacle 100.

The outer layer 112 can comprise a shrink-wrap and made of, for example, polyethylene terephtalate to provide additional oxygen barrier properties or polypropylene to provide additional moisture barrier properties. Both materials can also act as acceptable graphics carriers. One embodiment of the container uses a polyvinyl chloride shrink wrap 112, which adds additional light barrier properties when used as a graphics carrier and some additional moisture barrier properties.

The list of acceptable materials for use in either the receptacle 100 or the outer layer 112 is not exhaustive. Rather, any material available in the field of art that provides the adequate barrier properties along with desirable molding, rigidity, and graphics characteristics can be used in combination.

To further reduce manufacturing costs and complexity, the embodiment shown in FIG. 1*b* illustrates that the outer layer 112 is wrapped such that it covers all but the top end 110*a* of the cap 110 and the bottom or base 104 of the container. By not wrapping the top of the cap 110*a* and the bottom 104 of the container, the application of the outer layer shrink-wrap 112 is simplified and requires less material per container. The potential loss of barrier property provided by the outer layer in this design is minimal because the bottom 104 of the container will typically rest on a hard surface and, at least until opened, the container mouth 102 further incorporates a removable seal which can provide substantial barrier properties of its own. Alternatively, the outer layer 112 could be wrapped only over the receptacle 100, thereby further saving manufacturing costs.

In a vendable embodiment of the present invention, the height of the receptacle 100 from the mouth end 102 to the bottom 104 is approximately 6.63 inches. The diameter of the receptacle 100 at its maximum dimensions above and below the center section 106 is approximately 2.75 inches. The maximum circumference of the container above and below the center section 106 should be identical, in order to provide support between adjacent containers when proceeding down a processing line, when stacked on store shelves, or packed for shipping, by allowing contact between the containers both below and above the center of gravity of each. This contact at the bottom and top of adjacent containers helps with the stability of the containers when placed in contact. The minimum circumference of the center section 106, in this vendable embodiment, is approximately 2.4 inches. The total height of the container with the cap 110 nested on the mouth end 102 in this embodiment is 7.84 inches. Such dimensions are suitable for vending the container from a standard 20-oz. soft drink vending machine.

As shown in FIG. 1*a*, the mouth end 102 is slightly tapered both to properly nest in the cap 110 and to provide a pouring function from the mouth end 102 into the cap 110 or other receptacle. Further, the tapered shape helps prevent unintended spillage of the product out of the mouth end 102.

Figure 2A:
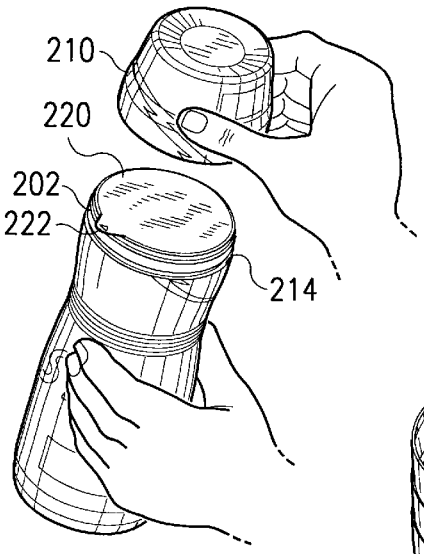
FIGS. 2*a* and 2*b* are perspective views illustrating the removal and filling of the multifunctional cap in one embodiment of the invention.
Figure 2B:
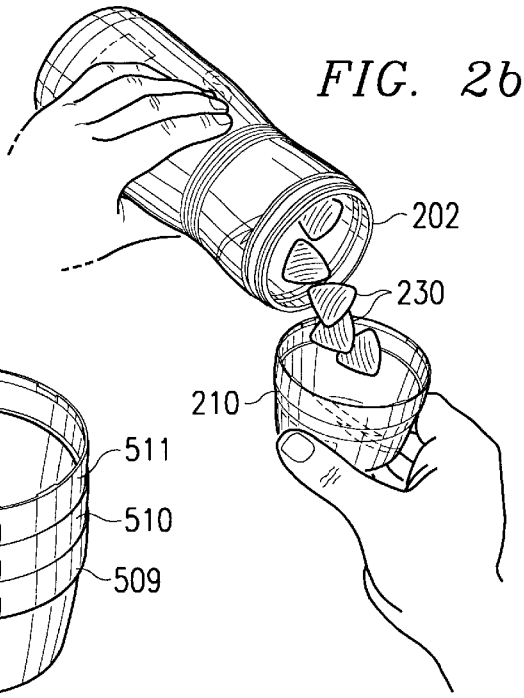

FIGS. 2*a* and 2*b* show the container in use by a consumer. First, the consumer removes the cap 210 by twisting the cap 210 and breaking the outer layer at the intersection of the cap 210 and a rim 214 below the mouth end 202. The removal of the cap 210 reveals the seal 220 affixed to the mouth end 202. The seal 220 is removed by pulling on an exposed tab 222.

Once the seal 220 is removed, the contents of the container, such as a puff-corn snack 230, can be poured into the cap 210. The product 230 can also be poured directly into the consumer's mouth. To reseal the container, the cap 210 is again nested over the mouth end 202.

Figure 3:
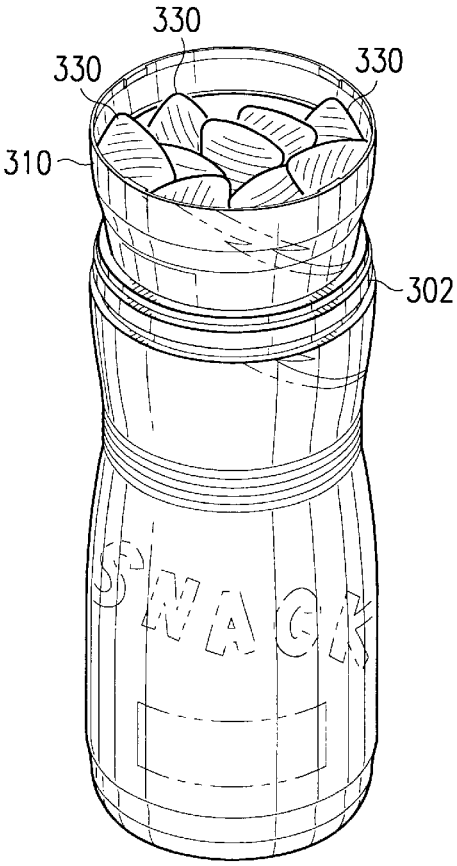
FIG. 3 is a perspective view of a cylindrical embodiment of the invention with the cap inverted and seated in the open end of the container.

The container is designed to provide a convenient one-hand use, as illustrated in FIG. 3. Once filled, the inverted cap 310 can then be seated in the mouth end 302 of the container, thus both holding product 330 for consumption and sealing the container. Since the vendable design of the container closely approximates a 20-oz. bottle of soft drink, the container can be held in one hand while the consumer removes product 330 from the inverted cup 310 with the other hand. The container can also be placed in a typical cup holder inside a vehicle while the consumer is consuming the product 330 from the inverted cap 310.

Figure 4:
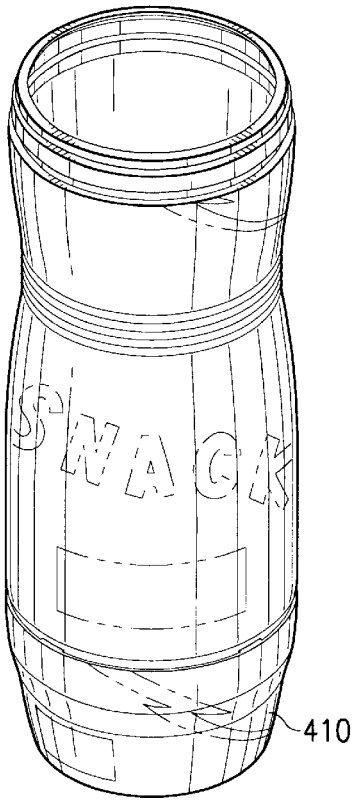
FIG. 4 is a perspective view of a cylindrical embodiment of the invention with the cap nested on the bottom of the container.

Another function of the cap allows for it to be stored at the bottom of the container. This is illustrated in FIG. 4, which shows the cap 410 nested over the base of the container. In this configuration, the consumer can pour product directly into the consumer's mouth, hand, or other container without worrying about holding the cap 410 or placing it in a location for later retrieval and resealing of the container.

Figure 5:
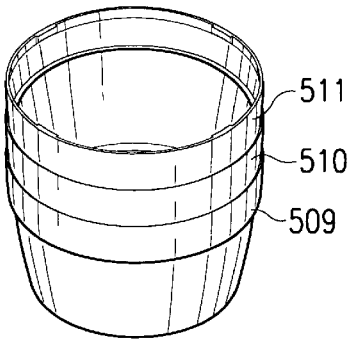
FIG. 5 is a perspective view of caps of one of the embodiments of the invention stacked together.

FIG. 5 illustrates another feature of one embodiment of the invention. Specifically, three caps 509, 510, 511 are shown stacked together to illustrate the packing efficiencies accorded by the cap design. Specifically, a collar around the open end of the cap (which is the only portion of the middle cap 510 exposed) provides for easy stacking and unstacking of the caps after manufacture and prior to installation on the receptacle. This collar promotes automatic stacking of the cups without sticking together and increases the hoop strength of each individual cap. Further, it is understood that the cap can be manufactured of material and in a manner similar to that discussed with regard to the manufacture of the receptacle portion of the invention.

The embodiment illustrated involves a generally cylindrical shape. However, it should be understood that the invention could also comprise any number of shapes. For example, a triangular geometry could be used for the receptacle in order to accommodate stackable tortilla chips. A square or rectangular geometry could be used to accommodate square crackers or other similar products. Likewise, it may be desirable to construct an oval geometry for the receptacle, as opposed to circular geometry, to more closely approximate to the shape of form-fried and stacked potato chips. The geometry of the cap can be adjusted to match the geometry with the receptacle in order to provide the nesting, sealing, and seating functionality previously described. Further, the container could comprise other designs for the cap and mouth end of the container, including a gabled carton type opening. Examples of other alternative embodiments of the present invention, illustrating primarily various container and cap designs that can be incorporated in any number of combinations, are shown in FIGS. 6*a*, 6*b*, 6*e*, 6*d*, 7*a*, 7*b*, 7*c*, 8*a*, 8*b*, and 8*c*.

Figure 6A:
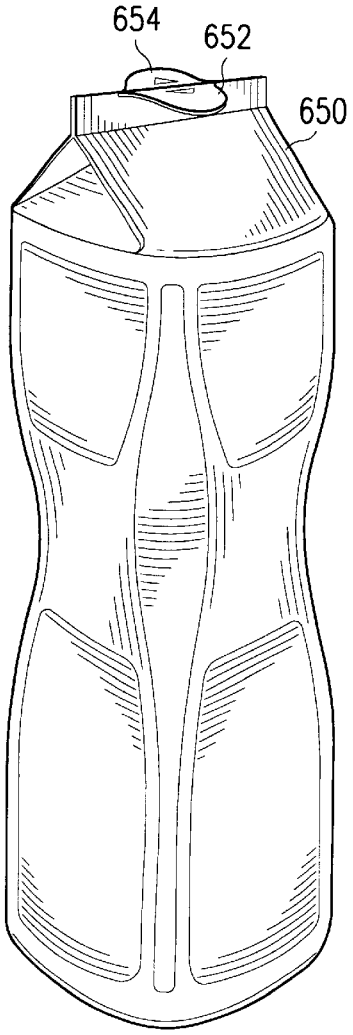
FIGS. 6*a*, 6*b*, 6*c*, and 6*d* are perspective and partial views of a gabled carton embodiment of the present invention.
Figure 6B:
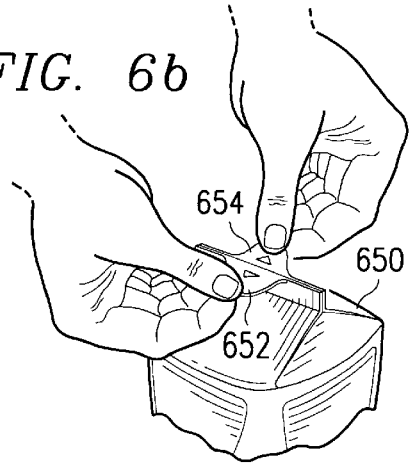
Figure 6C:
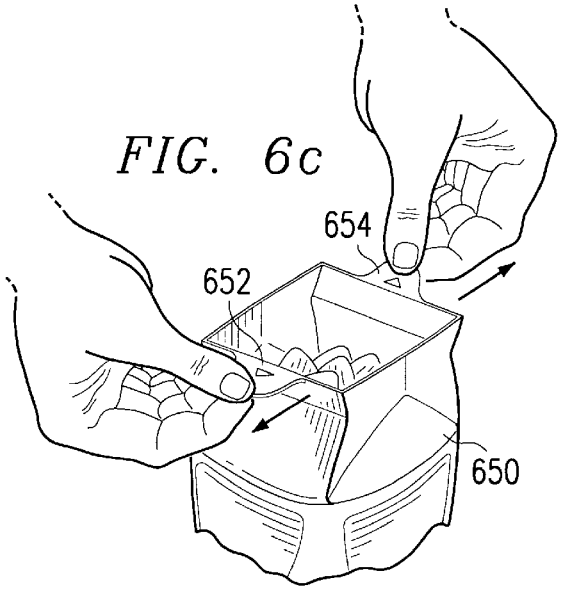
Figure 6D:
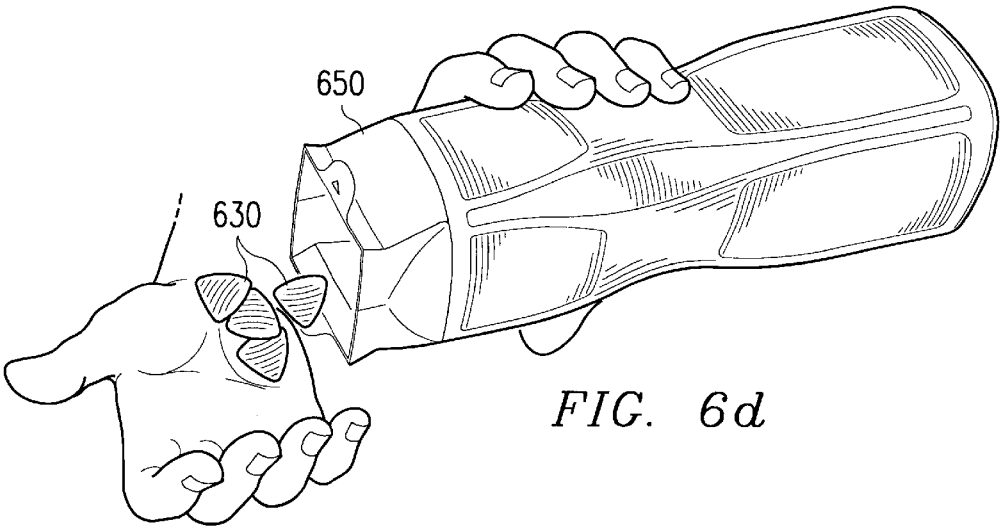

A gabled carton shaped embodiment is shown in FIGS. 6*a*, 6*b*, 6*c*, and 6*d*. This container can again be comprised of a receptacle and outer graphics layer as described previously with regard to the alternative cylindrical embodiments. Likewise, the shape of the container itself can be primarily square, as illustrated, cylindrical, triangular, or any other number of shapes to accommodate various product or promote various marketing considerations. A variation illustrated in this embodiment, however, is the gabled carton top 650. This top is opened by pulling apart two tabbed sealing members 652, 654. This opening action of pulling on the two sealing members 652, 654 is illustrated in FIGS. 6*b* and 6*c*. Once the gabled carton top 650 is opened, the product 630 can be poured out for consumption, as illustrated in FIG. 6*d*.

Figure 7A:
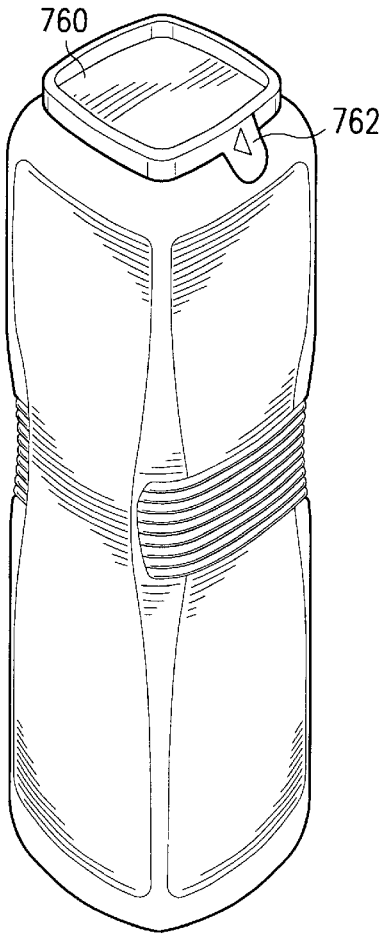
FIGS. 7*a*, 7*b*, and 7*c* are perspective and partial views of a tear-away cap and square shaped container embodiment of the present invention.
Figure 7B:
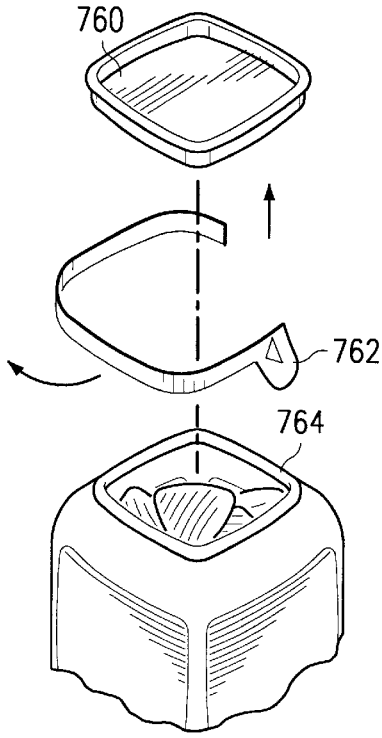
Figure 7C:
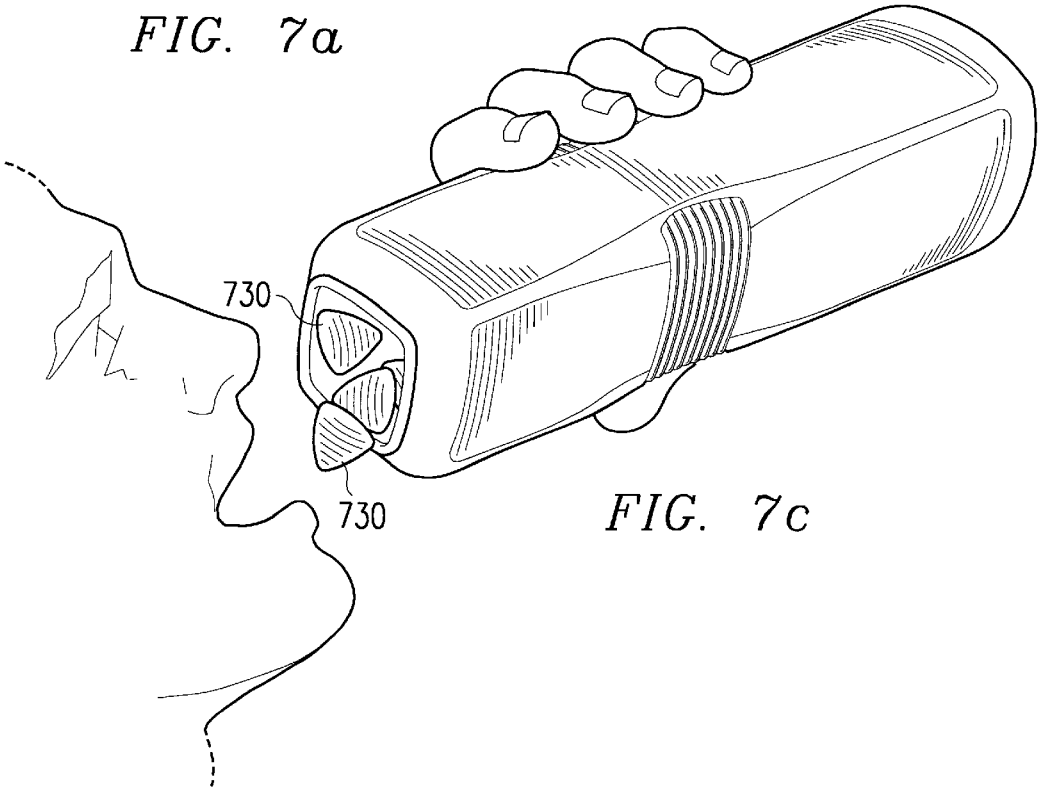

FIGS. 7*a*, 7*b*, and 7*c* show another variation on a square shaped container with a tear-away tab 762 which seals a cap 760 to the top of the container. To access the product, the consumer tears away a removable pull tab and seal portion 762 and removes the cap 760, as is illustrated in FIG. 7*b*. Removal of the cap 760 then makes the product 730 available to the consumer as is illustrated in FIG. 7*c*. The cap 760 in this embodiment can be snapped back onto the container, nesting in a ridge 764 defining the opening of the container.

Figure 8A:
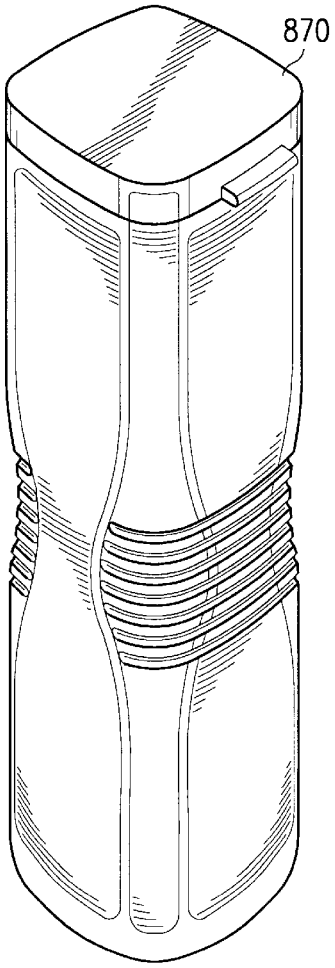
FIGS. 8*a*, 8*b*, and 8*c* are perspective and partial views of a pop-top cap and square container embodiment of the present invention.
Figure 8B:
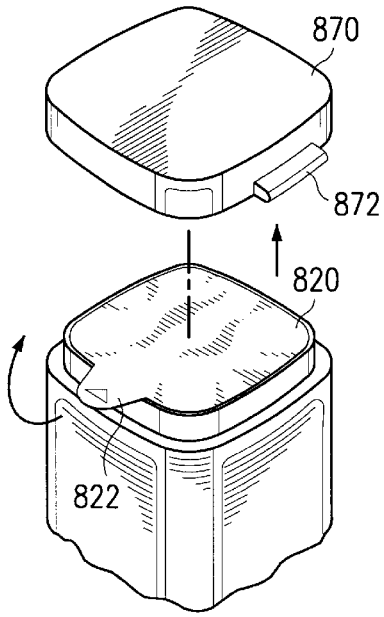
Figure 8C:
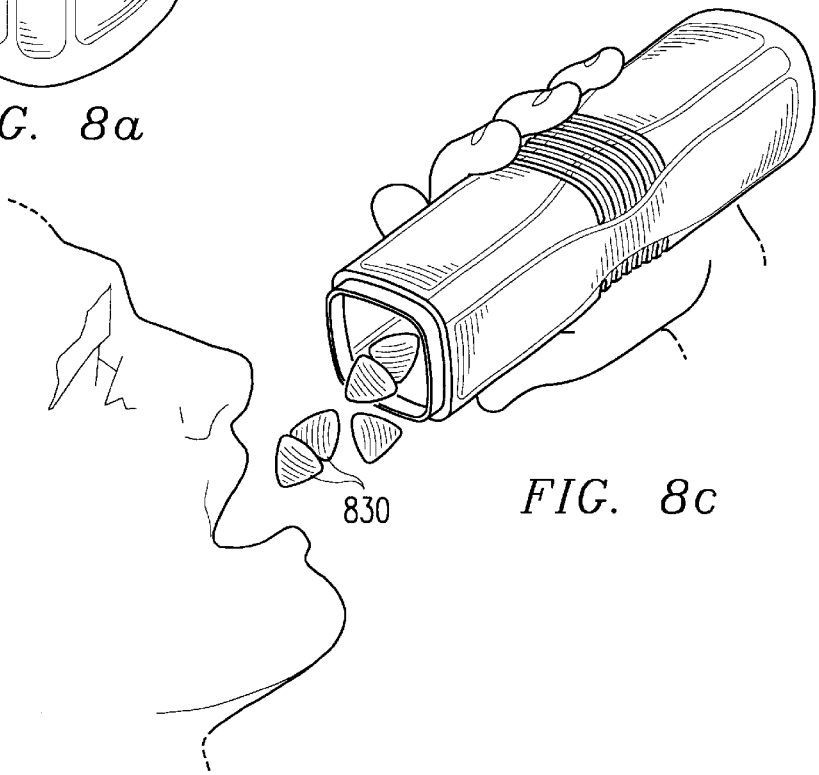

FIGS. 8*a*, 8*b*, and 8*c* illustrate another variation on a square shaped container that incorporates a snap-off lid 870. This snap-off lid 870 is removed from the container by pressing upward on an integral tab 872, as illustrated in FIG. 8*b*. This exposes a seal 820, which in turn is removable by pulling back on a tab 822 component. Once both the cap 870 and seal 820 have been removed from the container, product 830 can be dispensed from the container, as illustrated in FIG. 8*c*.

It should be understood that all of the alternative container embodiments discussed above can incorporate a multi-functional cap with a shape to accommodate the overall container shape. For example, a multi-functional cap could be used with the square container shapes illustrated in FIGS. 7*a* and 8*a*, wherein the cap would have a similar square shape in order to nest over the mouth of the container, seat in the mouth of the container when inverted, and nest for storage over the bottom of the container. Further, the discussion of specific container shapes and cap designs is not limiting on the invention, which focuses on the goal of a simple design with maximum utility for the consumer.

While the invention has been particularly shown and described with reference to a preferred embodiment, it will be understood by those skilled in the art that various changes in form and detail may be made therein without departing from the spirit and scope of the invention.

What is claimed is:

1. A container for food products comprising:

a receptacle having a first end and a second end;

a removable cap placed over said receptacle; and an outer layer wrapped over the receptacle and cap;

wherein said removable cap is nestable over said first and second ends and wherein said removable cap is usable as a bowl for holding a food product during consumption by a consumer.

2. The container of claim 1 wherein said outer layer comprises a graphics carrier that provides barrier properties.

3. The container of claim 1 wherein said cap is seatable on said first end of the receptacle such that the cap is usable as a bowl for holding product and sealing the container.

4. The container of claim 1 wherein said first end of the receptacle comprises a removable seal.

5. The container of claim 1 wherein the receptacle and outer layer provide complimentary oxygen and moisture barrier properties when layered together.

6. The container of claim 1 wherein said container comprises a generally cylindrical shape.

7. The container of claim 1 wherein said receptacle comprises a generally cylindrical tube with a slight circumferential restriction located between the first end and second end to provide for a hand grip for a consumer using the container.

8. The container of claim 1 wherein said cap comprises a collar.

9. A consumables container having a generally cylindrically shaped side wall, a first end defining an opening into said container, and a second end acting as a base for said container, said container comprising:

a removable cap nested over said first end; and a thin film graphics carrier wrapped over said container;

wherein said removable cap seats in the opening of said first end when inverted from the nested position over the first end, thus acting as a cup and sealing said first end.

10. The container of claim 9 wherein the cap nests over the second end for storage of the cup.

11. The container of claim 9 wherein the container and thin film comprise in combination effective oxygen and moisture barriers.

12. The container of claim 9 wherein the thin film graphics carrier comprises a shrink wrap over said container and cap.

13. The container of claim 9 further comprising a slight circumferential restriction located between said first end and said second end to provide for a hand grip for a consumer using the container.

14. The container of claim 9 wherein said cap further comprises a collar for facilitating stacking and increasing hoop strength.

15. A method for manufacturing a container for food products having a receptacle body with a base end and a mouth end, an outer layer, and a cap, said method comprising the steps of:

a) molding the receptacle body to a shape that allows for the cap to nest over the mouth end and base end;

b) filling said container through the mouth end with a snack product;

c) sealing said mouth end with a removable seal;

d) nesting the cap over said sealed mouth end; and e) wrapping said cap and receptacle with the outer layer.

16. The method of claim 15 wherein the container comprises a generally cylindrical tube with a slight circumferential restriction around the middle of the tube.

17. The method of claim 15 wherein the receptacle body and outer layers in combination provide effective barrier properties.

18. The method of claim 15 wherein step e) further comprises shrink wrapping said cap and receptacle body with the outer layer.

19. The method of claim 15 wherein step a) further comprises molding the receptacle body in a shape that allows for the cap to seat in the mouth end, thereby providing a means for sealing the mouth end and providing a bowl for the food product.

20. A container for holding a food product, said container comprising:

a receptacle having a generally cylindrical shape with curves forming a surface that can be grasped in one hand by a consumer such that said container can be conveniently gripped and transported by said consumer;

a first end defining an opening into said receptacle;

a second end acting as a base for said container; and a removable cap nested over said first end wherein said removable cap can be removed by said consumer and then re-nested over said first end to re-seal said container and wherein said removable cap can be inverted from a nested position over said first end and seated in said first end such that said removable cap acts as a bowl from which said consumer may consume said food product.

21. The container of claim 20 further comprising a thin film wrapped over said receptacle for providing additional barrier properties.

22. The container of claim 20 further comprising a thin film wrapped over said receptacle for providing a graphics carrier for labeling said food product.

23. The container of claim 20 wherein said curves comprise one or more circumferential constrictions located between said first end and said second end for providing a hand grip for said consumer.

24. The container of claim 23 wherein said removable cap can be attached to said second end of said container while said food product is consumed from said first end by said consumer.

25. The container of claim 24 wherein said container is vendable and wherein said food product is an edible snack food.

26. The container of claim 20 wherein said container is vendable and wherein said food product is an edible snack food.

27. A portable consumables container for holding a non-liquid snack product and for allowing said snack product to be consumed by a consumer directly from said portable consumables container, said container comprising:

a receptacle having a shape with curves forming a surface that can be grasped securely in one hand by a consumer such that said container can be conveniently gripped and transported by said consumer;

a first end defining an opening into said receptacle;

a second end acting as a base for said container; and a removable cap nested over said first end wherein said removable cap is shaped such that said removable cap can be removed by said consumer and then re-nested over said first end to re-seal said container, and wherein said removable cap is shaped such that when inverted from a nested position over said first end and seated in said first end said removable cap acts as a bowl from which said consumer may consume said food product while said removable cap seals said receptacle, and wherein said removable cap and said second end are shaped such that said removable cap can be removably attached to said second end to keep said removable cap with said container while said snack product is consumed by said consumer.

28. The portable consumables container of claim 27 further comprising an outer layer wrapped over said receptacle and said removable cap for holding said removable cap securely over said first end until said portable consumables container is opened by said consumer.

29. The portable consumables container of claim 27 wherein said portable container comprises a generally cylindrical shape that will allow said container to be distributed from a soft drink vending machine.

30. The portable consumables container of claim 29 wherein said receptacle comprises a generally cylindrical tube with a slight circumferential restriction located between said first end and said second end to provide for a hand grip for said consumer.

31. The portable consumables container of claim 30 wherein said removable cap comprises a collar for facilitating stacking and increasing hoop strength.

* * * * *